US006405553B1

(12) United States Patent
Willett

(10) Patent No.: US 6,405,553 B1
(45) Date of Patent: Jun. 18, 2002

(54) WALL MOUNTED ICE MAKING MACHINE

(76) Inventor: Mark E. Willett, P.O. Box 203635, Austin, TX (US) 78720

( * ) Notice: Subject to any disclaimer, the term of this patent is extended or adjusted under 35 U.S.C. 154(b) by 0 days.

(21) Appl. No.: 09/730,713

(22) Filed: Dec. 6, 2000

(51) Int. Cl.[7] ..... F25D 19/00
(52) U.S. Cl. ..... 62/298; 62/344
(58) Field of Search ..... 62/298, 344, 352

(56) References Cited

U.S. PATENT DOCUMENTS 4,680,943 A * 7/1987 Mawby et al. ..... 62/300
4,754,615 A * 7/1988 Linstromberg ..... 62/300
5,165,255 A * 11/1992 Alvarez et al. ..... 62/344
5,211,030 A * 5/1993 Jameson ..... 62/344
5,408,834 A * 4/1995 Schlosser et al. ..... 62/344
5,878,583 A * 3/1999 Schlosser et al. ..... 62/344
6,058,731 A * 5/2000 Byczynski et al. ..... 62/344

* cited by examiner

*Primary Examiner*—William E. Tapolcal
*Assistant Examiner*—Mohammad M. Ali
(74) *Attorney, Agent, or Firm*—Rick B. Yeager

(57) ABSTRACT

An ice machine configured in such a manner that all of its components, controls, and connections allow it to be secured to a wall at a location, conserving floor space while facilitating proper sanitation and ease of service. This is achieved by employing a bi-level design in order to increase efficiency of space use. The resulting configuration allows for decreased ice bin depth encroaching upon floor space adjacent to the wall at such a location. Alternate embodiments include bi-level remote condenser and remote condenser unit designs.

13 Claims, 4 Drawing Sheets

WALL MOUNTED ICE MAKING MACHINE

FIELD OF INVENTION

This invention relates to ice machines, and in particular to an internally contained, wall mounted, dual plane cubed ice-making machine.

BACKGROUND

The current design relates to a field of icemakers in which the evaporator unit is mounted in a common chassis along with the compressor and condenser components. This embodiment is widely known in the field of the prior art as "self-contained."

In most conventional designs, the condenser, compressor, evaporator, and all necessary components are located within a single module, typically on a single plane supported by an ice bin.

The current design features many advantages over the prior art. It is easier to keep clean in that it is flush with the wall so that there is no need to clean between the unit and the wall; and it is positioned off the ground so it is easy to clean underneath the unit.

The preferred embodiment employs a dual plane mounting system in order to decrease the distance the machine and bin protrudes from the wall. This feature reduces floor space requirements, and the reduced width of the unit helps contribute to compliance with the American Disabilities Act by allowing for increased hall width for wheel chairs.

The invention also moves the internal components toward the front access panel to contribute to ease of repair. It is also adaptable in order to fit most desired applications.

The invention provides the capability to use multiple ice bins which allows for continued operation and to build a reserve of ice for peak operation.

During the ice production stage, the machine transfers a refrigerant gas from the compressor unit to the evaporator unit. Upon expansion of the compressed gas, the evaporator unit is cooled below freezing. Water is then run over or sprayed onto the ice-forming evaporator plate to form ice. When an adequate or predetermined amount of ice has been produced, a "cubed ice" machine is switched to an ice harvest mode by any of several means of detection. At this time, the evaporator is warmed slightly so that the frozen ice will thaw on the bottom and fall off of the evaporator plate into an ice collection bin. To accomplish this warming, a hot refrigerant gas is typically routed from the compressor straight to the evaporator, bypassing the condenser.

In alternate remote condenser embodiments, the condenser is located remote from the rest of the unit. In other remote condenser unit embodiments, both the condenser and the compressor are located remotely. These configurations permit heat to be released remotely, thereby increasing efficiency and eliminating heat gain in an occupied space. In these embodiments, the evaporator alone is smaller than the evaporator and condenser combined, thereby saving space and locating only the necessary components at the location at which the ice is needed. While the single unit configuration is economical in terms of cost, installation, and service, the lower heat generation and the reduced space requirement make the remote configurations popular for some applications.

The current invention provides materials cost savings for the remote configurations. The current art merely removes the condenser fans and condenser coil from the embodiment, and relocates those components outside of the local unit. In order to seal the unit at the location of the removed condenser coil, however, additional material must be utilized to cover the resulting gap or hole in the embodiment, resulting in an increased cost for the additional material. The current invention requires less material for the remote configurations by permitting less material requirement at the second or top level of the embodiment. The elimination of all or a portion of a second level support permits lower material costs and lower manufacturing labor costs.

The current invention also permits lighter gauge steel to be employed for structural support. The present art employs a base upon which all components are arranged on the single plane. The prior art base plate is typically of a strong material such as steel or plastic of any of several materials with a substantial thickness in order to support the weight of the compressor, which may be the most massive of the components, sometimes weighing up to 80 pounds. The smaller footprint of the new design requires less base plate material. Since the base is typically manufactured of ⅛" steel, while the housing and second level supports may be produced using 22-gauge sheet metal, a substantial cost reduction can be achieved, thereby permitting lower unit cost.

A disadvantage of the prior art is that it is difficult to maintain proper sanitation in the area between the back of a machine and a wall. This is because the machine is supported entirely by the ice bin and the electrical, water, and drain connections make it impractical or impossible to move the entire assembly to gain access. The current design is innovative in that the ice bin does not support the machine and may be easily moved to permit cleaning beneath the ice-making unit.

Another disadvantage of the prior art is that the unit typically located several inches away from the wall to allow for utility connections, and airflow for the self-contained condenser. This results in wasted floor space and an area difficult to clean and service. The fact that the current embodiment is mounted flush onto the wall and that the ice bin can be removed alleviates these problems.

The current invention also allows the internal components to be rearranged on the mounting panel. The flexibility permits the fan to be placed on either side of the machine so that the machine can be adapted to fit in either corner of a room. This lack of this versatility is a major drawback to the prior art.

The prior art includes small, Wall-mounted nugget ice dispensers such as Follet Corporation's model numbers H25T5A/W and H50T5A/W, for 25 and 50 pound dispensers. These machines are "point of use" machines, whereby a customer can dispense ice directly into a cup. These machines reduce the cost of labor required to refill the storage bin manually. The machines have relatively small storage bins. Inherent in the "point of use" design is the lack of a storage bin, mobile or otherwise. In these devices the ice maker itself is of single plane design and may be permanently attached to a small "hopper." An object of the present invention is to provide a dual-plane ice maker design suitable for both large and small applications.

The prior art utilizes portable ice bins or containers, and the batch filling of such ice bins. Examples include ice transport systems manufactured by the Follett such as the "Ice-DevIce" and ITS (ice transport system) products. These products consist of a large ice storage bin or hopper of capacities in the range of 700 to 3,250 pounds of ice. The hopper is supported on legs above the floor surface, allowing a portable ice container to be rolled or placed under the hopper, and then allow a "batch" of ice to be dumped into the portable container. In these applications, the ice-maker is fixed to the top of the storage bin is not movable. An object of the current invention is to provide economical ice-making machines in a variety of capacities. Another objective of the current invention is to provide a more flexible and portable ice-making machine.

Ice making machines are well known in their prior embodiment. U.S. Pat. No. 5,752,393 issued on May 19, 1998 to Manitowoc Foodservice Group, Inc, an automatic ice making machine is disclosed having a coolant/refrigerant system, a water system, a cleaning/sterilizing system and a microprocessor operated control system interconnecting the above systems. Methods for automatically cleaning the water and ice systems and establishing safeguards and monitoring of system readiness and operation are also provided.

U.S. Pat. No. 5,787,723 issued Aug. 4, 1998 to Manitowoc Foodservice Group, Inc. a remote ice-making machine is disclosed having a compressor unit remote from an evaporator unit, a supply line for transferring refrigerant from the compressor unit to the remote evaporator unit, and a return line for returning refrigerant from the evaporator unit to the compressor unit during an ice-making mode. In the current invention, the compressor unit may be located remotely from the ice-making machine. The preferred evaporator unit has an ice-forming evaporator and a heating unit, as well as a valve for controlling the flow of refrigerant into the evaporator unit.

A major drawback to the prior art machines is that their single plane attachment plate makes access to rear components difficult. Another object of the current invention is to improve access to the machine components during service and installation. A major drawback to the prior art machines is that their single plane attachment plate makes access to rear components difficult.

SUMMARY

The preferred embodiment of the current invention is a wall mounted, internally contained, dual plane ice making machine. This machine is intended to save space, and facilitate proper sanitation while producing ice efficiently and economically.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

In the preferred embodiment of the current design, the ice-making components of a self-contained design are located on two levels and in a way that repair is efficient.

Figure 1:
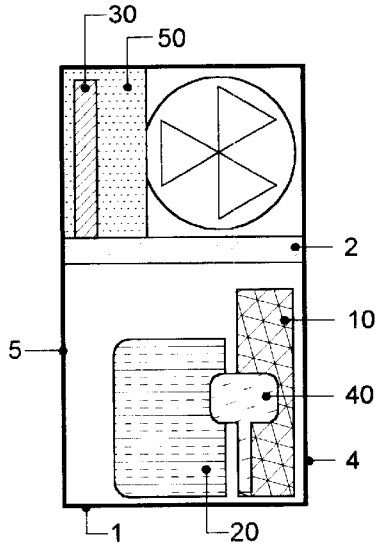
FIG. 1 is a side view showing the condenser coils and control compartment situated above the evaporator and compressor compartments.

Referring now to FIG. 1 which is a side view, the housing is comprised of a first bottom level 1, and a second top level 2, a rear panel 4, and a front panel 5.

Figure 2:
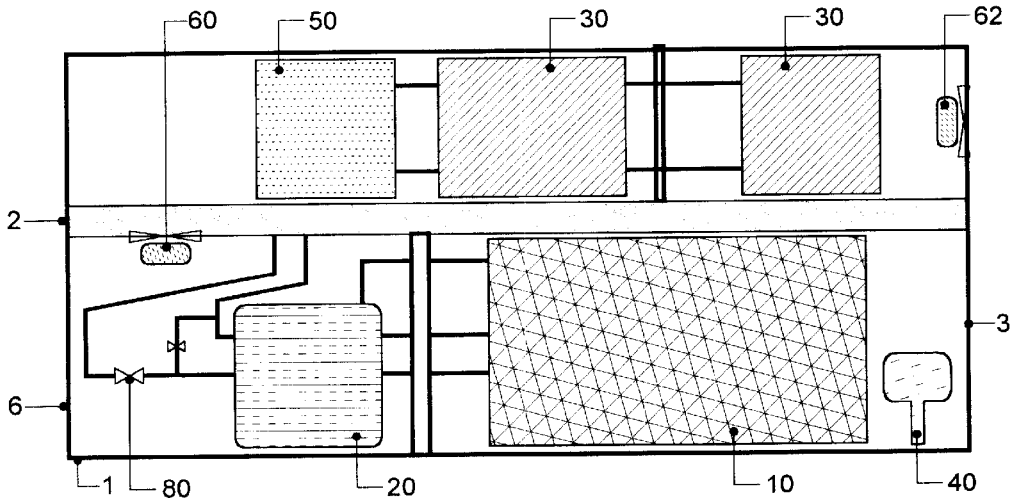
FIG. 2 is a front view of the machine, with the condenser coils and control compartment above the evaporator and compressor compartment, and the compressor compartment adjacent to the evaporator compartment.
Figure 3:
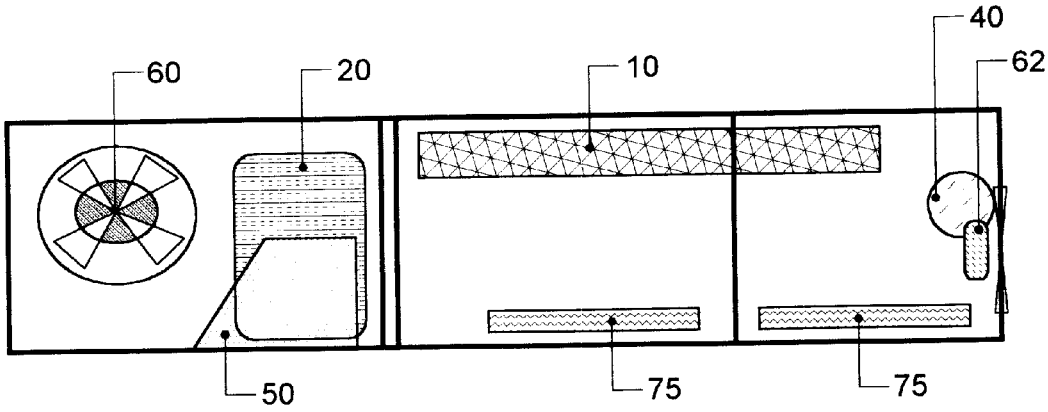
FIG. 3 is a top view showing the configuration of the components as viewed from the top.

Referring now to FIG. 2 which is a front view, the left side panel 6 and the right side panel 3 are shown. The top level contains the control enclosure 50 mounted on the left and the condenser coils 30. Referring now to FIG. 3 which is a top view, the fan and motor 62 are mounted on the right side panel 3 to permit air to be drawn from outside the unit and forced through the condenser coil(s) 75. A fan also may be employed to draw air through the compressor compartment as required for condenser requirements and compressor cooling 60. On the bottom level 1, the roughed in power and water or T.E.V. connections 80 are mounted on the left, followed by the compressor 20 and evaporator 10. The water pump 40 is the mounted on the right. This orientation may be reversed horizontally to fit a different application.

The current design uses a dual plane mounting system, which effectively moves all the components close to the front access panel. This makes service and repair easier.

Figure 4:
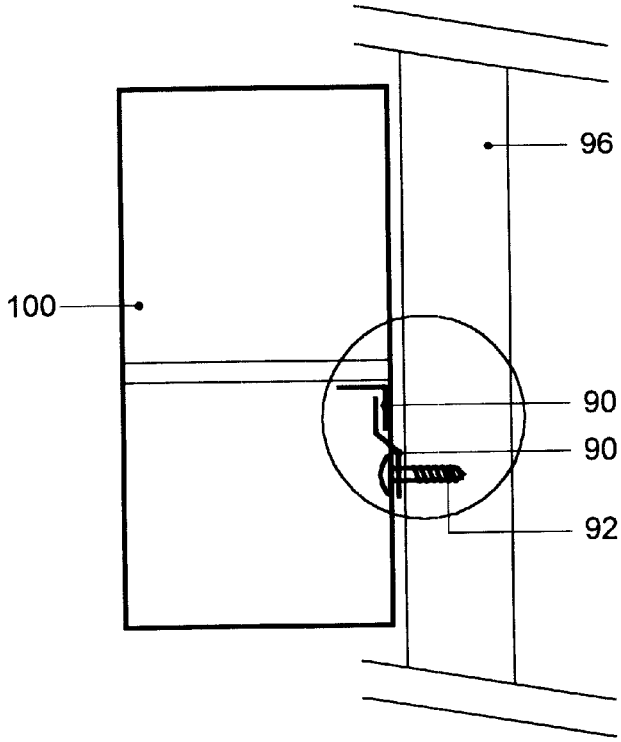
FIG. 4 is a detailed view showing the preferred manner in which the machine is secured to a wall. Using one long "Z-clip" to provide support and permit ease of removal of the ice making machine.
Figure 5A:
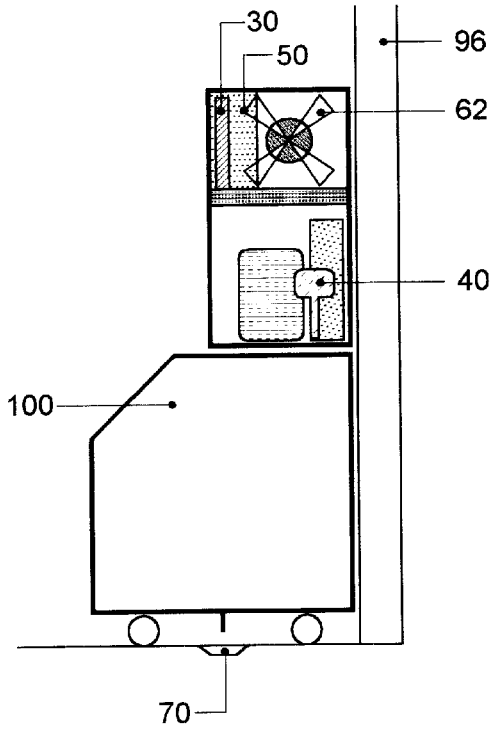
FIG. 5 is a side view showing the orientation and location of the ice storage bin.
Figure 5B:
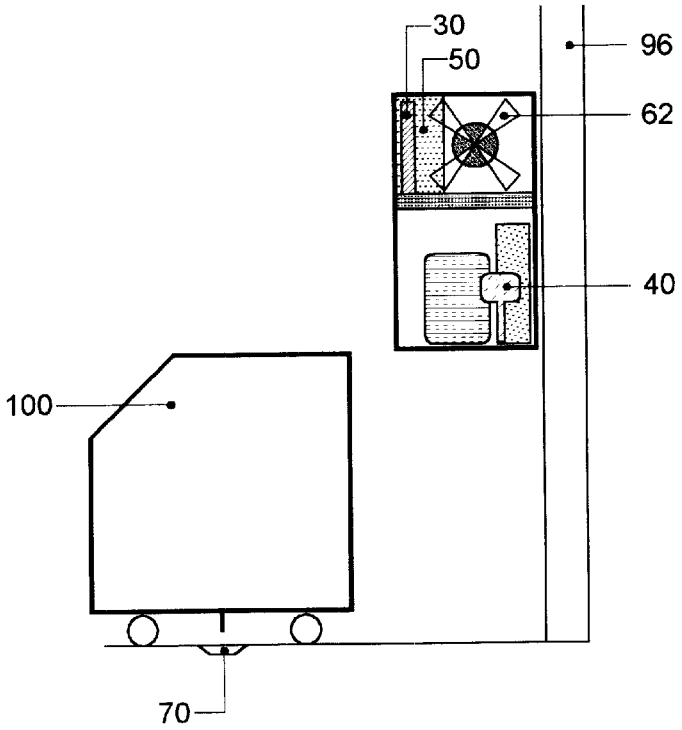

Referring now to FIG. 4, the use of a Z clip 90 is a common practice in securing other types of equipment, such as scullery sinks and water coolers, to walls. In this preferred wall mounting, the long Z-clip is secured to the wall 96 with screws 92 on a 6–8 inch spacing. The rear housing panel 4 includes a slot which is slightly longer than the Z-clip and approximately ½ inch wide so that it engages between the Z-clip and the wall in order to support the housing.

Figure 6:
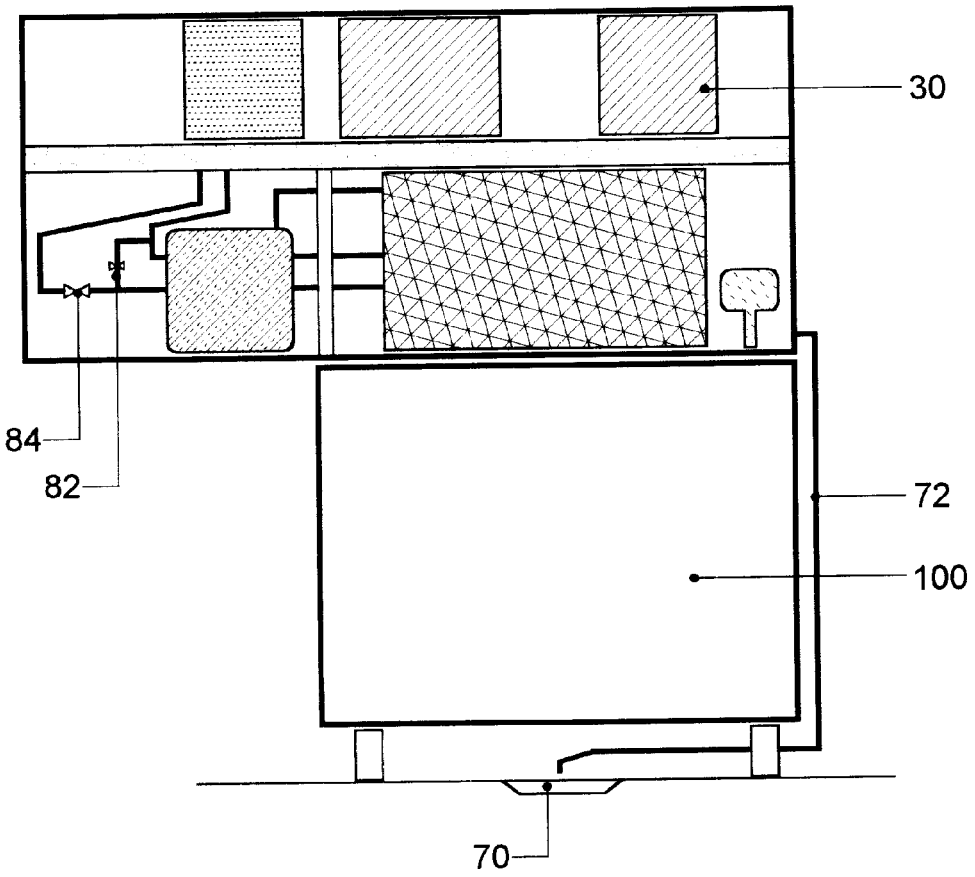
FIG. 6 is a side view showing the detail of the preferred service connections.

Referring now to FIG. 6, it is typical for a sanitary floor drain 70 to be at the location of an ice maker installation. Other configurations are possible, such as flexible drain line, or drain with shut-off valve to facilitate the mobility of an ice storage bin 100 in this configuration. A proximity switch, which may be magnetic, mechanical, or electronic, may be included to sense when the ice bin has been removed and halt the ice harvest process for applications with multiple ice bins.

In a new installation, the water connection 82 and electrical connections 84 are roughed in at the location of the machine in such a manner as to eliminate exposure of the connections, which are often subject to abuse and damage in the existing art. It is recommended that the wastewater drain line from the ice machine be provided with a union to facilitate disconnection upon the need to remove the machine from the wall. Other configurations regarding the utility connections are acceptable, or could be optional at the side of the unit if required. Ice bin configurations could vary in terms of narrowing the depth of the bin, and widening it to maintain capacity and decrease encroachment upon the floor space.

Alternate Embodiment—Remote Condensor

The current design may be modified to locate the condenser coils and fan externally to the machine. This design is typically used in larger machines in order to increase the machine efficiency and eliminating heat gain in an occupied space. The remote location also decreases the noise and vibration of the main unit. In the present invention, this design is accomplished by omitting the condenser coil(s) and fan(s). Typically, this omission reduces the space requirements of the second level.

Alternate Embodiment—Remote Condensor Unit

A variation to the remote condenser design is a remote condenser unit design where condenser coils and fan and the compressor are located externally to the machine. In the present invention, this design is accomplished by omitting the condenser coils and the compressor from the machine. Since the compressor is typically the heaviest component, its removal typically allows a lighter first level support. Typically, this omission typically reduces the space requirements of the first and second level.

Alternate Embodiment—Rolling Bin

The preferred embodiment may be altered in order to fit a specific application. It could come equipped with a transferable ice bin to allow for transport. This is practical in applications where the ice needs to be distributed to locations remote from the ice-making unit. The set up could also include two bins so one could be in transport while the other is being used to collect ice. A sensor would be included that would tell the processor when no bin was present and prevent the harvest mode from occurring. Alternatively, the bin could employ legs instead of wheels. This would still allow for movement of the ice collection bins.

Alternate Embodiment—More than Two Levels

In this embodiment, a narrower profile is achieved by employing more than two support levels. In addition to reducing the unit profile, this embodiment permits components to be located closer to the access panel.

What is claimed is:

1. An ice making machine comprising:

a housing, the housing including
- a first level,
- a second level located substantially above the first level, and
- a wall attachment means such that the housing is secured to at least one wall; and components including at least a compressor, a condenser, an evaporator, condenser coils, a water pump, a control enclosure, fans and fan motors, water and electrical connections, and a gas bypass valve, such that at least one of the components is positioned on the second level and at least one component is positioned on the first level; and a movable ice bin positioned below the first level such that ice can be released directly from the machine to the bin.

2. The machine of claim 1 wherein there are a plurality of interchangeable ice bins that may be positioned below the first level without moving the housing.

3. The machine of claim 2 wherein the bin has a plurality of wheels to permit transportation of the bin.

4. The machine of claim 1 such that the housing is secured to a single wall in a corner.

5. The machine of claim 1 wherein the wall attachment means includes a slotted rear panel integral to the housing, and at least one clip means such that at least one slot accepts a clip which is secured to the wall, such that the clip engages and supports the rear panel.

6. The machine of claim 1 wherein the wall attachment means includes a housing rear support means which is screwed to the wall.

7. The machine of claim 1 wherein the housing includes a metal frame;

a first level sheet metal shelving;

a second level sheet metal shelving; and a sheet metal front cover and a first side and a second side.

8. The machine of claim 7 wherein the sheet metal front cover includes an access panel, such that the access panel may be removed to service the components.

9. The machine of claim 1 wherein the wall attachment means is mounted such that the first level of the housing is positioned approximately 4 feet above the floor.

10. The machine of claim 1 wherein the machine is self-contained such that all components are located within the housing;

the first level supports the electrical and water connections, the compressor, the evaporator, and the water pump; and the second level supports the control enclosure, the condenser coils, and the fans and fan motors.

11. The machine of claim 1 wherein the machine is a remote-condenser design, such that the condenser coils are located remote to the machine;

the first level supports the electrical and water connections, the compressor, the evaporator, and the water pump; and the second level supports the control enclosure, and the fans and fan motors.

12. The machine of claim 1 wherein the machine is a remote-condensing-unit design, such that the compressor and the condenser coils are located remote to the machine;

the first level supports the electrical and water connections, the evaporator, and the water pump; and the second level supports the control enclosure, and the fans and fan motors.

13. A self-contained ice making machine comprising:

a housing, the housing including
- an angled metal frame;
- a first sheet metal shelving level which supports electrical and water connections, a compressor, an evaporator, and a water pump;
- a second sheet metal shelving level located substantially above the first level, containing a control enclosure, condenser coils, and fans and fan motors;
- a slotted rear panel which engages a Z-clip which is secured to the wall, such that the clip engages and supports the rear panel, such that the first level is positioned at a height of approximately four feet above the floor;
- a sheet metal front cover; and at least one movable ice bin positioned below the first level.

* * * * *